US006131997A

United States Patent [19]

Cao

[11] Patent Number: 6,131,997

[45] Date of Patent: Oct. 17, 2000

[54] LOCKING DEVICE FOR A ROTATABLE CHAIR OR TABLE

[76] Inventor: Zi-wen Cao, 9th Floor, 145, Ta An Road, Taipei City, Taiwan

[21] Appl. No.: 09/311,444

[22] Filed: May 14, 1999

[51] Int. Cl.[7] ..... A47C 1/02

[52] U.S. Cl. ..... 297/344.22; 297/344.19

[58] Field of Search ..... 108/103; 248/131, 248/415, 161, 405, 404, 418, 157; 297/344.22, 344.21, 344.12, 344.18, 344.19

[56] References Cited

U.S. PATENT DOCUMENTS

| | | |
|---|---|---|
| 965,113 | 7/1910 | Konstantinides . |
| 2,293,144 | 8/1942 | Jones . |
| 2,634,795 | 4/1953 | Bishop . |
| 2,914,793 | 12/1959 | McMahan, Sr. . |
| 3,741,514 | 6/1973 | Snurr . |
| 4,928,620 | 5/1990 | Currey . |
| 4,951,328 | 8/1990 | Potvin . |
| 4,977,848 | 12/1990 | Currey . |
| 5,556,170 | 9/1996 | Lai et al. . |

*Primary Examiner*—Milton Nelson, Jr.
*Attorney, Agent, or Firm*—Alan D. Kamrath, Esq.; Oppenheimer Wolff & Donnelly

[57] ABSTRACT

A locking device for a rotatable chair or table includes a middle vertical tube, an annular closing member fixed on an upper end of the middle vertical tube, a protective outer tube fitting around the middle vertical tube, having an inner wall provided with the same shape of as the annular closing member and having a plurality of screw holes formed in an upper end portion, and screws screwing in the screw holes of the protective outer tube. The screws can be screwed inward tightly against an outer surface of a piston rod extending out of the air pressure bar contained in the middle vertical rod. When the piston rod is locked immovable by the screws, the chair or table is also locked immovable, being fixed tightly with an upper end of the piston rod.

5 Claims, 6 Drawing Sheets

LOCKING DEVICE FOR A ROTATABLE CHAIR OR TABLE

BACKGROUND OF THE INVENTION

This invention relates to a locking device for a rotatable chair or table, particularly to one locking the chair or table temporarily and restoring its rotatable condition easily according to practical necessity.

Conventional chairs or tables generally are of two kinds, stationary ones or rotatable ones, having different uses for people to choose. Conventional rotatable ones are always rotatable, not having a locking device to lock them temporarily immovable. Thus, when it is needed to stop rotation, there is no way to effect it, resulting in inconvenience sometimes.

SUMMARY OF THE INVENTION

This invention has been devised to offer a locking device for a rotatable chair or table, including screws screwing through an upper end wall of a protective tube fitting around a middle vertical tube supporting a piston rod of an air pressure bar in its interior. The screw can then be screwed tightly against the piston rod, which has an upper end fixed with the chair seat or a table so that the chair or the table may be kept immovable temporarily.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
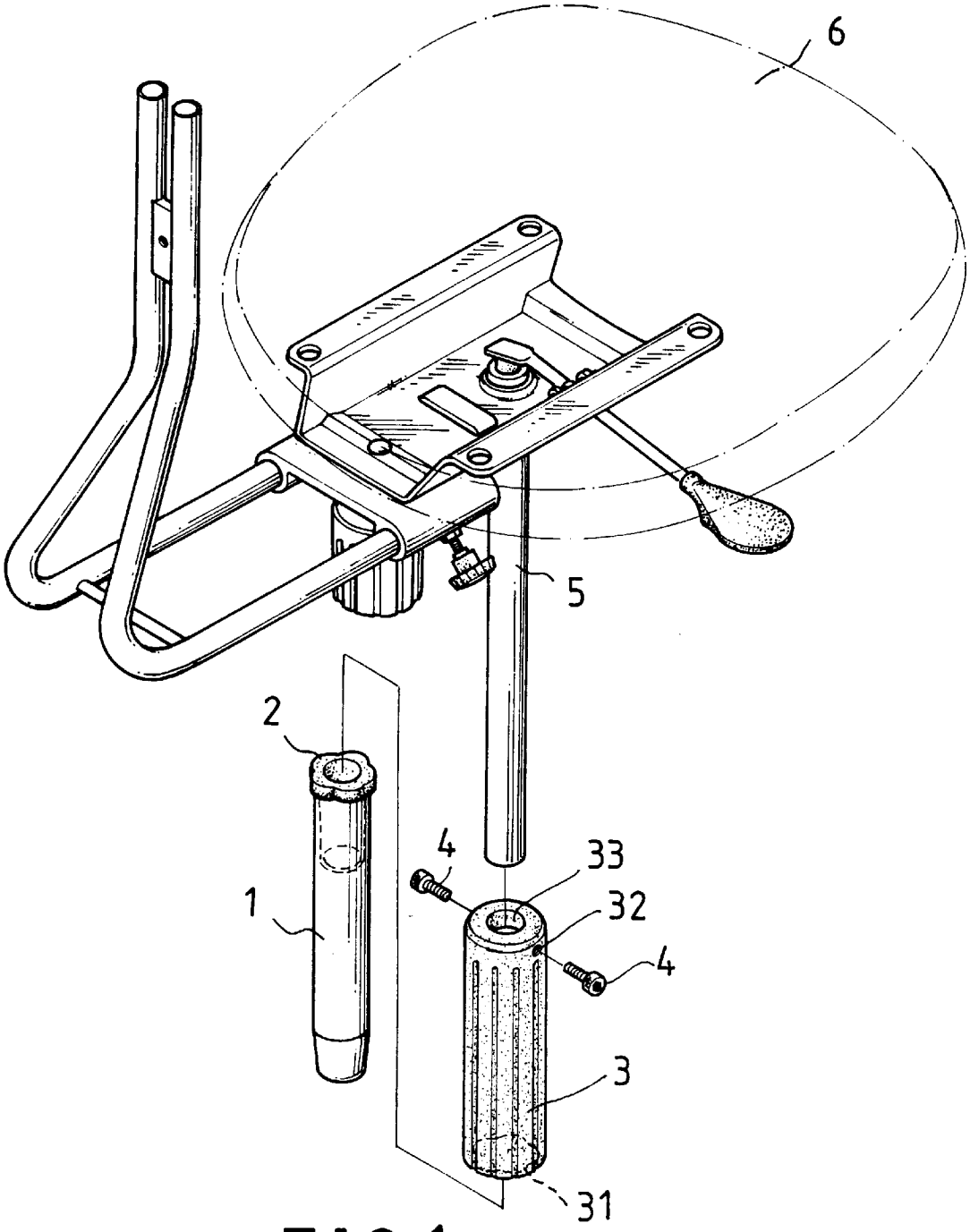
FIG. 1 is an exploded perspective view of a locking device for a rotatable chair or table in the present invention.
Figure 2:
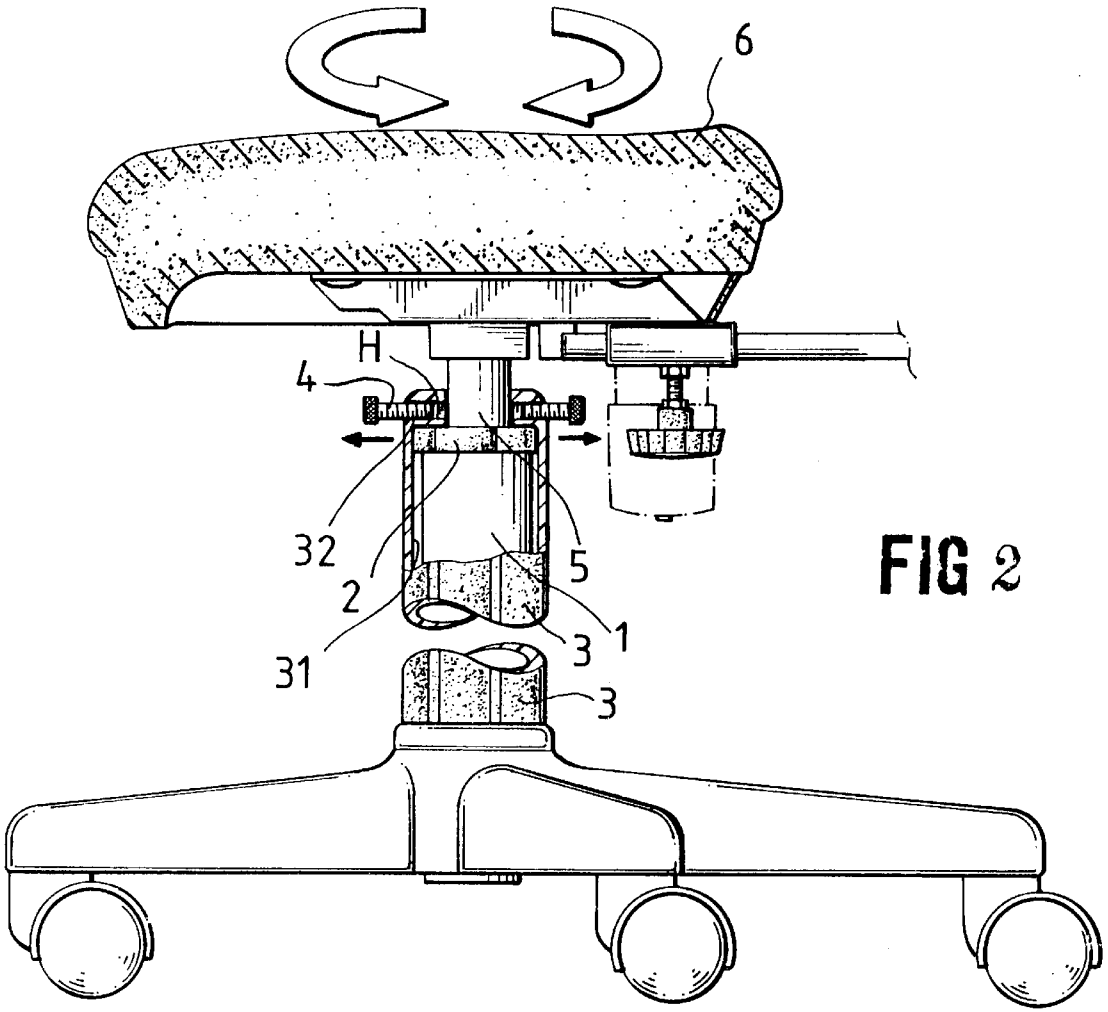
FIG. 2 is a side view of the locking device for a rotatable chair or table in the present invention.
Figure 6:
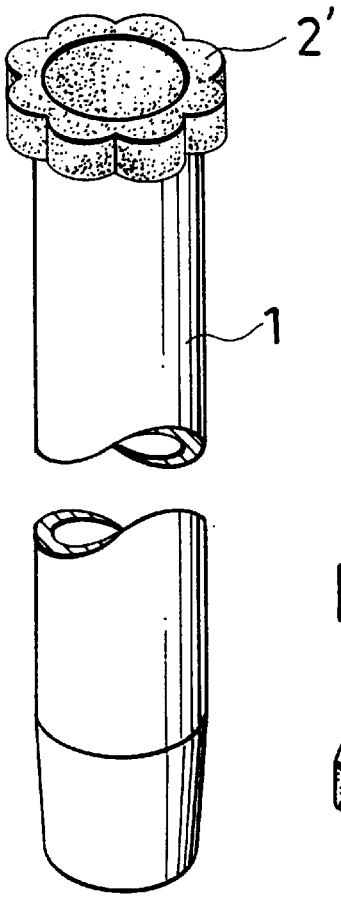
FIG. 6 is a perspective view of a first embodiment of an annular closing member on the middle vertical tube in the present invention.
Figure 7:
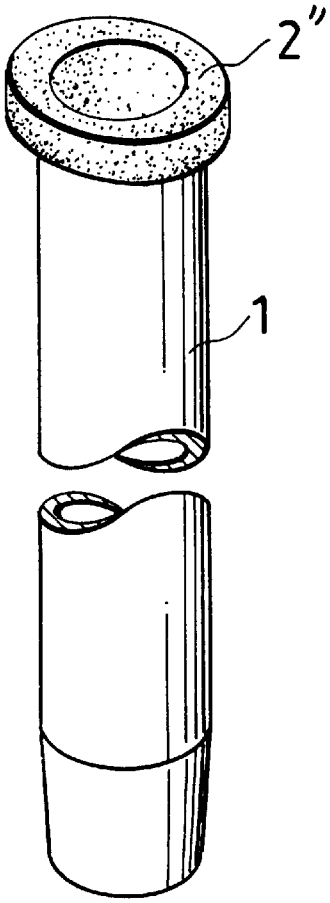
FIG. 7 is a perspective view of a second embodiment of an annular closing member on the middle vertical tube in the present invention.
Figure 8:
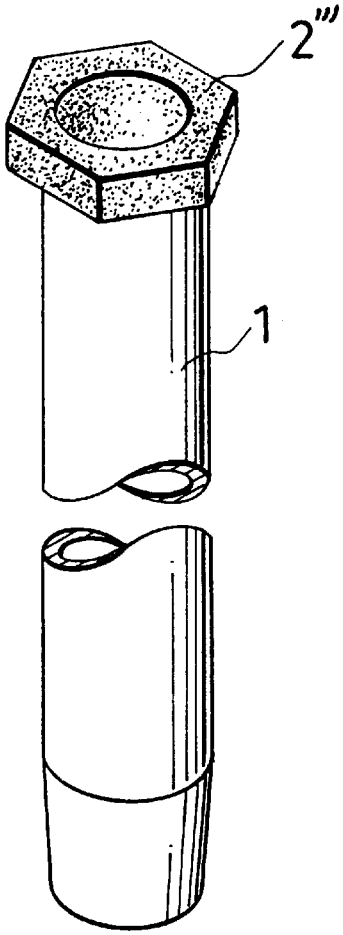
FIG. 8 is a perspective view of a third embodiment of an annular closing member on the middle vertical tube in the present invention.

A preferred embodiment of a locking device for a rotatable chair or table in the present invention, as shown in FIGS. 1 and 2, includes a middle vertical tube 1 for supporting an air pressure bar in its interior, an annular closing member 2 fixed on an upper end of the tube 1 and having a non-circular circumferential shape such as a plum blossom shape 2', an oval shape 2", a multiple flat or curved side shape 2'", as shown in FIGS. 6, 7 and 8, and a protective outer tube 3 having an inner wall 31 shaped as that of the annular closing member 2 for fitting vertically around the middle vertical tube 1 and a plurality of screw holes 32 formed around an upper end portion for screws 4 screwing the screw holes 32 inward in and through hole 33 formed in an upper end of the outer tube 3, to press tightly against an outer surface of a piston rod 5 extending out of an air pressure bar contained in the middle tube 1.

Figure 3:
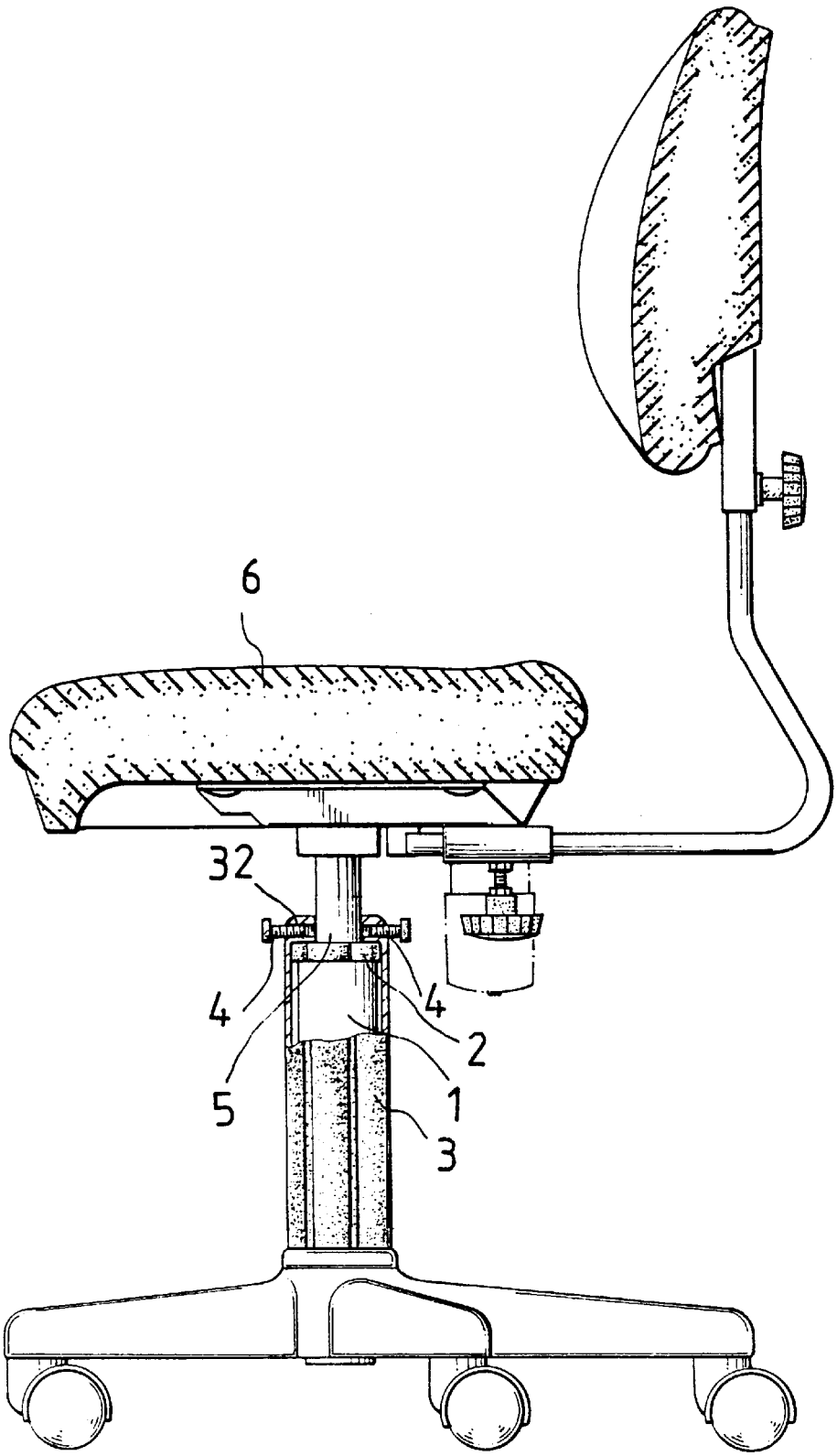
FIG. 3 is a side view of the locking device applied to lock a rotatable chair or table immovable in the present invention.
Figure 4:
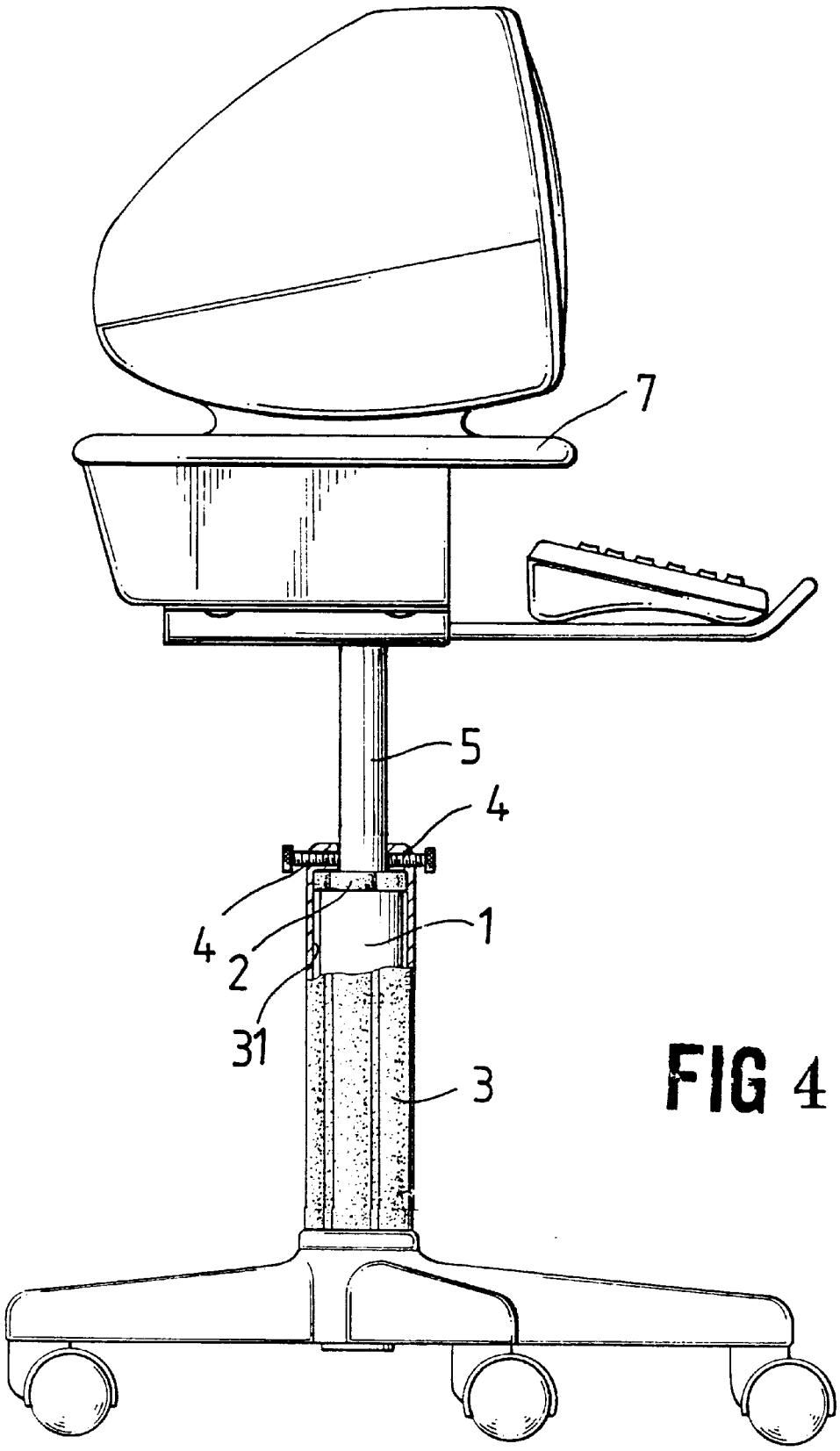
FIG. 4 is a side view of the locking device applied to lock a rotatable table in the present invention.
Figure 5:
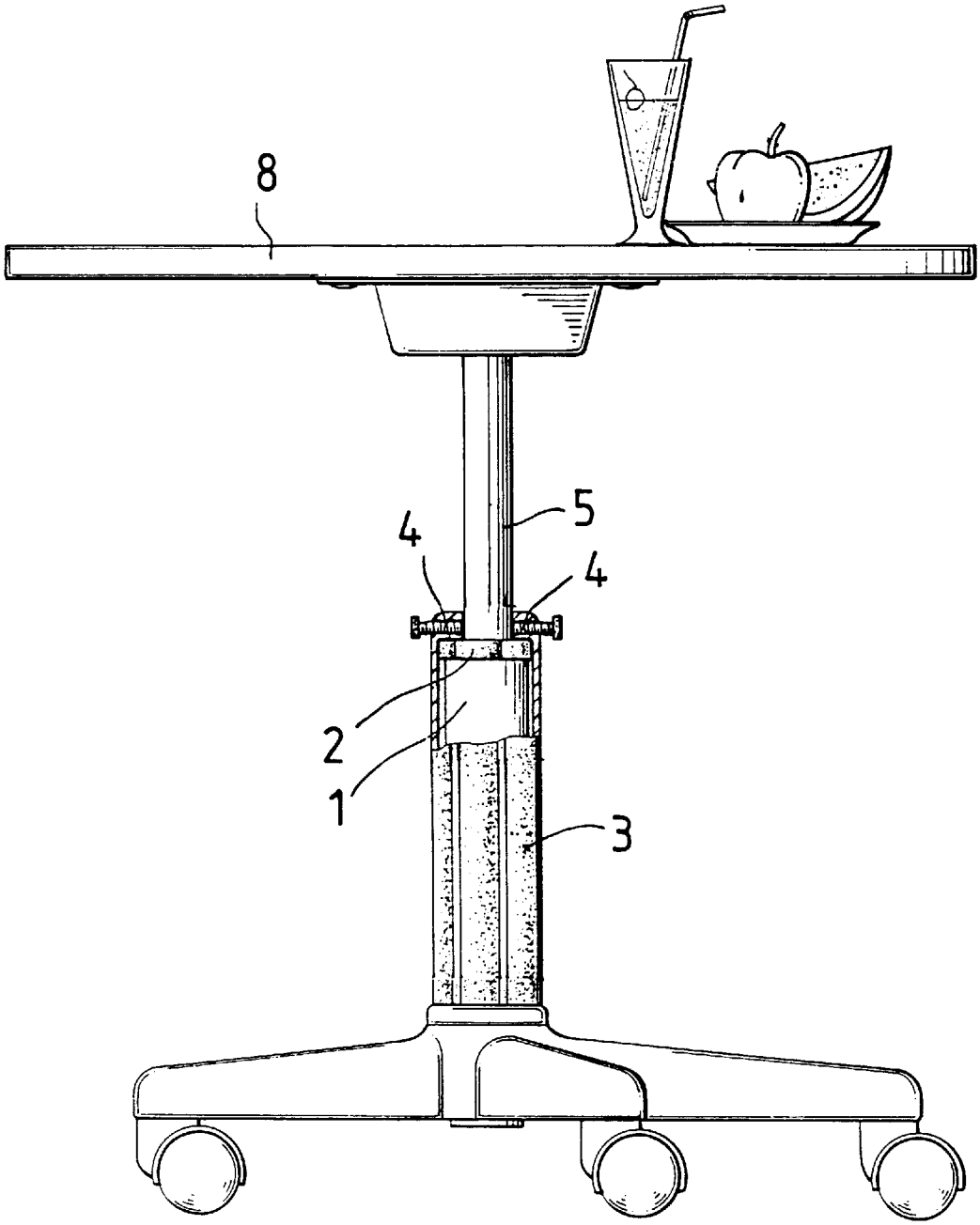
FIG. 5 is a side view of the locking device applied to lock a rotatable tea table in the present invention.

In use, if a person wants to use the rotatable chair in the rotatable condition, the screws 4 are rotated outward to form a gap H (referring to FIG. 2) between the screws 4 and the outer surface of the piston 5 in the middle tube 1, permitting the chair to be free to rotate and convenient and comfortable to sit on. When the rotatable chair 6 is wanted to be stationary, the screws 4 are manually screwed inward tightly against the outer surface of the piston rod 5 as shown in FIG. 3, hampering the piston rod 5 from rotation and subsequently also the chair or table from rotating.

Thus, the locking device in the invention may be applied to a rotatable chair 6, table or tea table 8, computer table 7, etc.

As understood from the aforesaid description, the invention has the following advantages.

1. A rotatable chair or table can be easily and very conveniently locked immovable by screwing manually the screws 4 inward tightly against the piston rod supported in the middle tube.

2. A rotatable chair or table can be rotatable or stationary by applying the locking device in the invention, widening the usable scope of the chair or table.

3. The locking device can be applying manually without any tools, and is very easy to operate.

While the preferred embodiment of the invention has been described above, it will be recognized and understood that various modifications may be made therein and the appended claims are intended to cover all such modifications which may fall within the spirit and scope of the invention.

What is claimed is:

1. A locking device comprising, in combination: an air pressure bar; a middle vertical tube for containing the air pressure bar, a piston rod extending out of said air pressure bar, an annular closing member fixed on an upper end of said middle vertical tube, and a protective outer tube fitting around said middle vertical tube and having an inner wall provided with the same circumferential shape as said annular closing member, said protective outer tube having a plurality of screw holes formed in an upper end portion of the protective outer tube, screws screwed in the screw holes inward tightly against an outer surface of the piston rod extending out of said air pressure bar, said piston rod being locked immovable by the screws.

2. The locking device as claimed in claim 1, wherein said annular closing member has a plum flower shape, and said inner wall of the protective outer tube also has the same shape as said annular closing member to fit in said middle vertical tube.

3. The locking device as claimed in claim 1, wherein said annular closing member has an oval shape, and said inner wall of the protective outer tube also has the same shape as said annular closing member to fit in said middle vertical tube.

4. The locking device as claimed in claim 1, wherein said annular closing member has a multiple side shape, and said inner wall of the protective outer tube also has the same shape as said annular closing member to fit in said middle vertical tube.

5. The locking device as claimed in claim 4, wherein said annular closing member has a multiple flat side shape.

* * * * *